US005819490A

United States Patent [19]

Current

[11] Patent Number: 5,819,490

[45] Date of Patent: Oct. 13, 1998

[54] SLATWALL SECTION AND METHOD FOR MAKING SAME

[75] Inventor: Wayne A. Current, Holmdel, N.J.

[73] Assignee: International Visual Corporation, Port Washington, N.Y.

[21] Appl. No.: 726,161

[22] Filed: Oct. 4, 1996

[51] Int. Cl.[6] ..... E04C 2/30

[52] U.S. Cl. ..... 52/588.1; 52/592.1; 52/36.5; 52/630; 211/94.01

[58] Field of Search ..... 52/630, 588.1, 52/592.1, 36.4, 36.5, 36.6, 38; 211/94.01, 94.02

[56] References Cited

U.S. PATENT DOCUMENTS

| | | | |
|---|---|---|---|
| 4,531,331 | 7/1985 | Itagaki | 52/38 |
| 4,603,068 | 7/1986 | Hunter | 428/54 |
| 4,674,240 | 6/1987 | Strausheim | 52/36.1 |
| 4,694,965 | 9/1987 | Parnell | 211/87 |
| 4,809,479 | 3/1989 | Tierno et al. | 52/588.1 |
| 5,170,605 | 12/1992 | Huddle | 52/588.1 |
| 5,409,120 | 4/1995 | Miller et al. | 211/87 |
| 5,647,184 | 7/1997 | Davis | 52/592.1 |

*Primary Examiner*—Robert Canfield
*Attorney, Agent, or Firm*—Collard & Roe, P.C.

[57] ABSTRACT

A slatwall section having a groove formed above and behind the upper most slat for providing additional structural integrity. The formed groove enables a slatwall to be manufactured having uniform thickness. A mating engagement between upper and lower slatwall sections provides a connection point that is concealed within a formed slat, and thereby eliminates the use of exteriorly disposed sink holes or fasteners.

6 Claims, 2 Drawing Sheets

SLATWALL SECTION AND METHOD FOR MAKING SAME

BACKGROUND OF THE INVENTION

1. Field of the Invention

The present invention relates to Slatwalls. More particularly, it relates to an improved design for slatwalls that is easier to manufacture and provides increased strength and quality.

2. The Prior Art

Slatwalls have a front surface formed by horizontally elongated front members separated by horizontally elongated grooves. The grooves receive supports, such as braces and hangers, which, in turn, support shelves and the merchandise that is being displayed. Slatwalls are used extensively for wall displays because of the versatility that they offer as far as placement of the supports to be mounted thereon.

Often slatwalls are formed as extruded horizontally elongated sections that are interlockingly connected with similar upper and lower slatwall sections to form a slatwalls panel. Generally, the upper and lower horizontal ends of the slatwall sections have connectors which mesh with those of the vertically adjacent sections to secure the sections together. Thus, several panels are used to form a slatwall. It is important that the coupling between vertically adjacent slatwall sections be such that the finished slatwall is sturdy. Furthermore, the spacing between the front slat members of the slatwall sections should be uniform to maintain an aesthetically pleasing and even appearance. In addition, the grooves in the slatwall should be designed to promote stable engagement between the slatwall and the supports that are mounted on within the grooves.

SUMMARY OF THE INVENTION

According to the invention, a slatwall section is provided having a body with a plurality of spaced slats for receiving hangars and other display devices. The body has an upper end and a lower end. The upper end includes a groove formed above the uppermost slat in the section such that the slate wall section has an entirely uniform thickness. The groove also formed an upper protrusion that frictionally engages the lower coupling leg of the adjacent slatwall section. The upper end also includes an upper coupling leg having a coupling bore therein.

The lower end of the slatwall section has a lower coupling leg formed by a notch in the back surface of the lower end of the section, and coupling bore disposed therein. Upon connection of two slatwall sections the upper coupling leg of the lower slatwall section is inserted between the upper coupling leg of the lower slatwall section and the upper protrusion formed by the groove. The upper coupling leg of the lower slatwall section abuts the notch in the lower end of the upper slatwall section such that the coupling bores of the upper and lower coupling legs are axially aligned. Once aligned, a fastener of any suitable type can be inserted therethrough.

It is therefore an object of the present invention to provide an improved slatwall construction of uniform thickness.

It is another object of the invention to provide a slatwall construction that includes simplified connection means for coupling several slatwall sections together.

A further object of the invention is to provide a slatwall construction that is easy to use and simple to manufacture.

BRIEF DESCRIPTION OF THE DRAWINGS

Other objects and features of the present invention will become apparent from the following detailed description considered in connection with the accompanying drawings which disclose an embodiment of the present invention. It should be understood, however, that the drawings are designed for the purpose of illustration only and not as a definition of the limits of the invention.

In the drawings, wherein similar reference characters denote similar elements throughout the several views.

DETAILED DESCRIPTION OF PREFERRED EMBODIMENTS

Figure 1A:
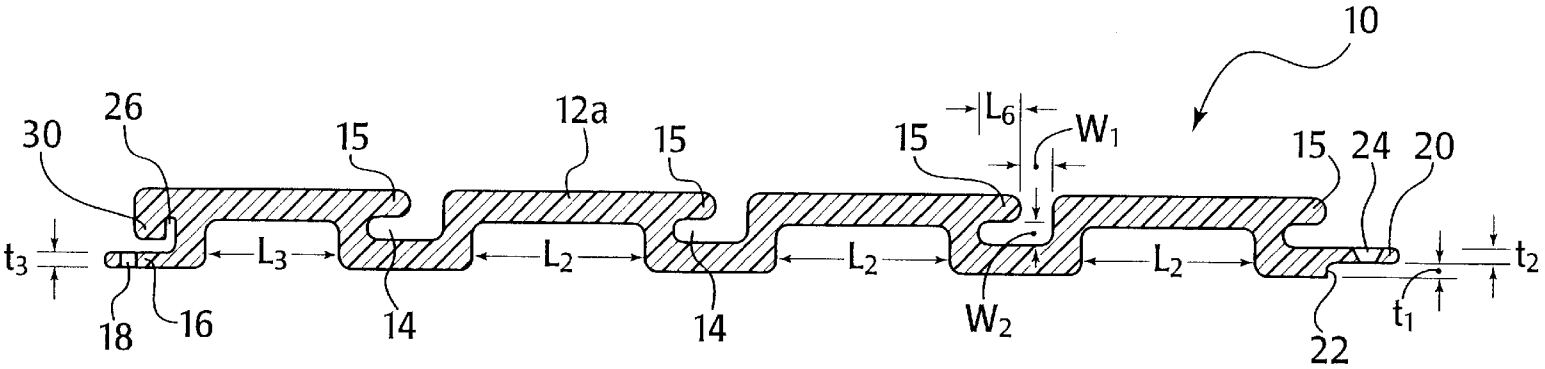
FIG. 1*a* is a cross-sectional view of the slatwall construction according to the invention.

Turning now in detail to the drawings, FIG. 1*a* shows a slatwall section 10 having a front side 12*a* with several L-shaped grooves/slats 14 for receiving the display supports (not shown). On the back side of a lower coupling leg 20, a notch 22 is provided for receiving the upper coupling leg 16 of another slatwall section. Notch 22 has approximately the same thickness $t_1$ as that of upper coupling leg 16 ($t_3$) such that when the upper coupling leg is disposed in an abutting relation with notch 22, the combined thickness ($t_1$+$t_3$) is substantially equal to the overall thickness $T_1$ of the slatwall section.

Slatwall section 10 has an upper portion/extension 30 that is formed by a groove 26 at the upper end above the upper most slat. Groove 26 has a width $w_5$ and provides additional support in the connection of two slatwall sections 12*b* and 12*c*. The provision of groove 26 enables slatwall section 10 to be molded with a uniform thickness $T_1$ throughout the entire design. The uniform thickness provides for easier manufacturing, and also increases the structural integrity of the overall slatwall construction.

FIG. 1*a* shows the slats 14 having an opening width $W_1$ and an internal space width $W_2$. L-shaped slats 14 are formed by extension 15 which has a length $L_6$ and width $W_3$. The width $W_3$ of extension 15 is slightly smaller than the thickness $T_1$ of the overall slatwall section. Extension 15 has external edges 46*a* and 46*b* that are rounded to help facilitate the insertion of a cantilevered hanging device into slat 14 (See FIG. 2*b*). In addition, the internal upper edges of the slats 14 have rounded edges 46*c* to further facilitate the receiving of a display hanger. The internal surface 42 of extension 15 (FIG. 2*a*) can also be tapered to aide in the ability to receive a display hanger.

Extension 15 will be subject to outward pressure caused by the insertion of a cantilevered hanging device. As the weight of the display hanger increased, the outward pressure on extension 15 will increase. Thus, extension 15 must be capable of withstanding pressure caused by display hangers. As such, extension 15 will have a very slight freedom of flexibility when subject to external pressure.

Figure 1B:
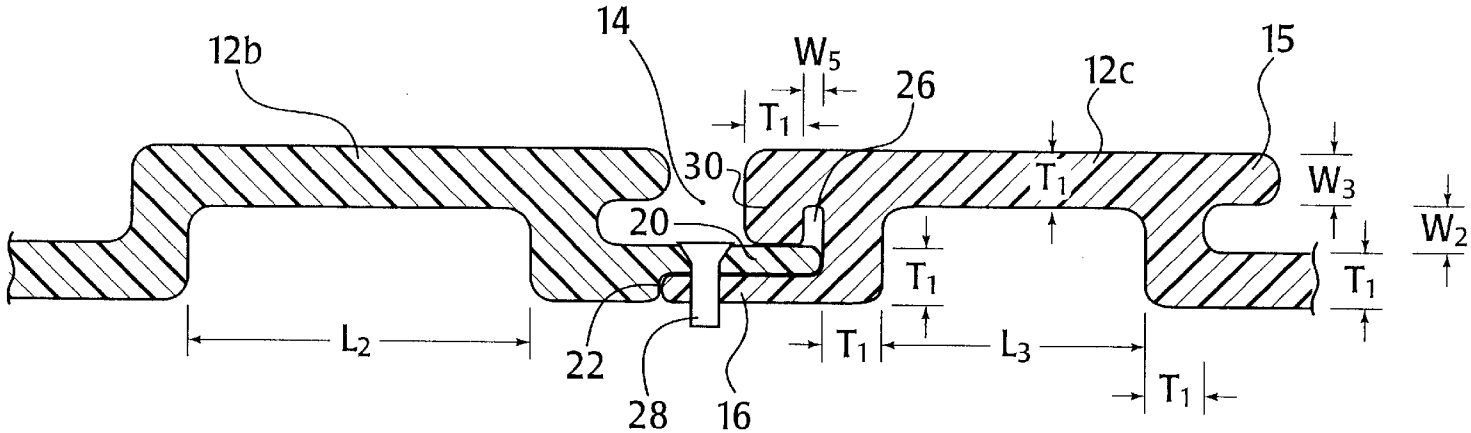
FIG. 1*b* is an enlarged cross-sectional view of the coupling of two slatwall sections according to the invention.

FIG. 1*b* shows the coupling of two slatwall sections 12*b* and 12*c* using a fastener 28. The upper coupling leg 16 of slatwall 12*c* is matingly joined with the lower coupling leg 20 of slatwall section 12*b* such that the holes 18 and 24 are axially aligned with each other, and leg 16 abuts notch 22. Once positioned such that holes 18 and 24 are axially aligned, fastener 28 is inserted therethrough to secure the connection between slatwall sections. Lower coupling leg

20 frictionally engages upper coupling leg 16 and extension 30 of the lower slatwall section 12*c*. This frictional engagement further increases the overall structural integrity of the connection between the two slatwall sections and therefore, the entire slatwall. The connection of the two slatwall sections 12*b* and 12*c* form a slat 14 for receiving display mounts. Thus, a uniform aesthetic appearance of the overall slatwall construction is achieved.

The placement of holes 18 and 24 in the overlapping leg portions 16 and 20, respectively, forms the connection point of the two slatwall sections within slat 14. This eliminates the use of sink holes or other types of connections on the exposed surfaces of the slatwall opposite groove 26. Fastener 28 can be any suitable known fastener for securing slatwall sections to each other and the structure on which they are mounted.

The thickness $T_1$ of the slatwall sections is uniform throughout the entire design with the exception of width $W_3$ of extension 15. The disposition of groove 26 at the upper end provides upper portion/extension 30 with the same thickness $T_1$ as the remaining parts of the slatwall construction. The width $w_5$ of groove 26 is variable in accordance with the design specifications of the slatwall to assure uniform thickness of the entire slatwall. The combined thickness of upper coupling leg 16 with lower coupling leg 20 (i.e., $t_1+t_3$) is substantially equal to the uniform thickness $T_1$ of the slatwall.

Slatwall sections 12 can be made from any known material such as, for example, plastics, metals, alloys, and any other suitable known material. The method of making the slatwall sections requires molding the slatwall section having a uniform thickness. In order to do this, groove 26 is formed above and behind the upper most slat of the slatwall section. In addition, notch 22 is formed in the lower end of the slatwall section for receiving the upper coupling leg 16 of another slatwall section such that the combined thickness of the coupled ends is substantially equal to the uniform thickness $T_1$ of the entire slatwall section.

Figure 2A:
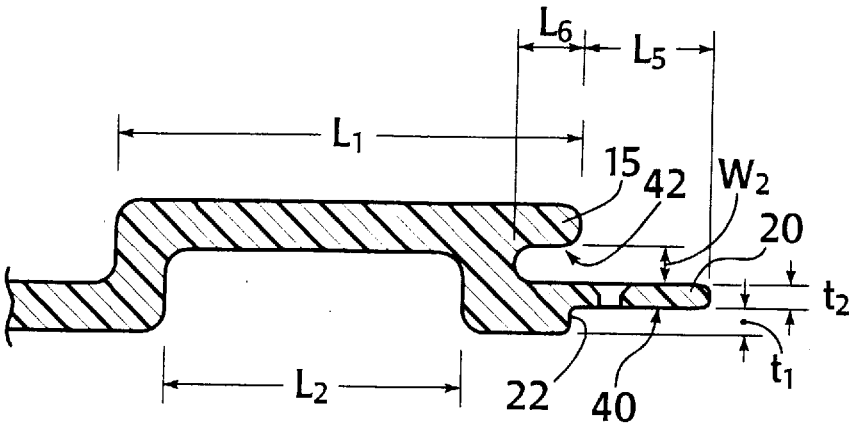
FIG. 2*a* is a detailed plan view of the lower end of the slatwall section according to the invention.

FIG. 2*a* shows a detailed view of the lower coupling leg 20 of the slatwall section. Leg 20 has a surface 40 that is tapered or slightly sloped toward notch 22. In a preferred embodiment, surface 40 is tapered at 2°. The distance between slat openings is defined by $L_1$. The distance $L_1$ is uniform across the entire slatwall section. On the underside of the slatwall section, there are cutouts defined by the slats 14 (FIG. 1*a*). These cutouts all have a length $L_2$ with the exception of the uppermost cutout adjacent upper coupling leg 16. The upper most cutout has a shortened length $L_3$ to accommodate the addition of upper extension 30. All of the cutouts have the same width $W_4$.

Figure 2B:
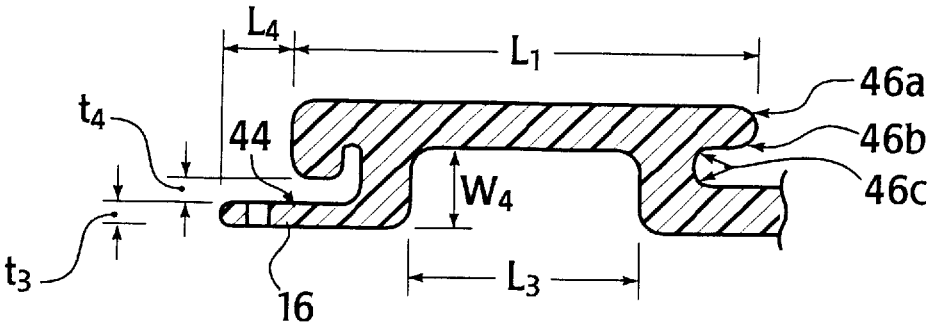
FIG. 2*b* is a detailed plan view of the upper end of the slatwall section according to the invention.

FIG. 2*b* shows a detailed view of the upper coupling leg 16. Coupling leg 16 has an upper surface 44 that is complimentarily tapered or sloped with respect to the tapered surface 40 of lower coupling leg 20. Surface 40 is preferably tapered at 2°.

In a particular embodiment of the invention, the uniform thickness $T_1$=0.29", $W_3$=0.27", $W_2$=0.23", $W_1$=0.35", and $L_6$=0.4". The distance $L_1$ between slats, and thereby the underside openings $L_2$ and $L_3$ are variable according to design. In the embodiment of FIG. 1*a*, $L_1$=2.65", $L_2$=1.67" and $L_3$=1.28". The width $W_4$ of the openings is equal to 0.5".

The thicknesses of the coupling legs 16 and 20 is of integral importance in the design of the slatwall section. Thickness $t_1$=0.14"±0.005" at the inside by notch 22, and 0.16"±0.005 at the end (considering the 2° taper of surface 40), $t_2$=0.13"±0.005", $t_3$=0.13"±0.005" at the very end of leg 16, and 0.15"±0.005" at the inside adjacent groove 26 (considering 2° taper of surface 40). The length $L_5$has a range of 0.65"–0.75" and the length $L_4$ has a range of 0.3"–0.4".

While one embodiment of the present invention have been shown and described, it is to be understood that many changes and modifications may be made thereunto without departing from the spirit and scope of the invention as defined in the appended claims.

What is claimed is:

1. A slatwall section comprising:

a body having a plurality of spaced slats for receiving hangars and other display devices, said body having an upper end, a lower end, a front surface, and a back surface;

said upper end comprising a groove formed above an uppermost slat, an upper coupling leg and a coupling bore in said upper coupling leg; and said lower end comprising a lower coupling leg, a coupling bore in said lower coupling leg and a notch formed on the back surface opposite said lower coupling leg, said notch adapted to receive an upper coupling leg of an adjacent slatwall section.

2. The slatwall section according to claim 1, wherein said groove formed above the upper most slat further forms an upper extension for frictionally engaging a lower coupling leg of an adjacent slatwall section.

3. The slatwall section according to claim 2, wherein said body of said slatwall section excluding said upper coupling leg, said notch and said lower coupling leg has a uniform thickness, and said lower coupling leg, said notch and said upper coupling leg have a thickness substantially equal to one half said uniform thickness.

4. The slatwall section according to claim 3, wherein when coupling two adjacent slatwall sections said coupling bore of said lower coupling leg of said slatwall section is adapted to be aligned with a coupling bore of an upper coup ling leg of a lower slatwall section.

5. The slatwall section according to claim 4, further comprising a fastener for fitting through said coupling bore and adapted to secure said slatwall section to an adjacent slatwall section and to a structure.

6. The slatwall section according to claim 5, wherein the connection of said lower coupling leg with an upper coupling leg of an adjacent slatwall section is adapted to form a slat for receiving hangers and other display devices, said formed slat adapted to conceal the connection of the adjacent slatwall sections.

* * * * *